US010036209B2

(12) United States Patent
Alsup et al.

(10) Patent No.: US 10,036,209 B2
(45) Date of Patent: Jul. 31, 2018

(54) CUTTING ELEMENTS AND BITS FOR SIDETRACKING

(71) Applicant: Schlumberger Technology Corporation, Sugar Land, TX (US)

(72) Inventors: Shelton W. Alsup, Houston, TX (US); Shantanu N. Swadi, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 48 days.

(21) Appl. No.: 14/936,793

(22) Filed: Nov. 10, 2015

(65) Prior Publication Data

US 2016/0130881 A1 May 12, 2016

Related U.S. Application Data

(60) Provisional application No. 62/078,025, filed on Nov. 11, 2014.

(51) Int. Cl.

| | |
|---|---|
| ***E21B 10/46*** | (2006.01) |
| ***E21B 10/55*** | (2006.01) |
| ***E21B 10/56*** | (2006.01) |
| ***E21B 10/567*** | (2006.01) |

(52) U.S. Cl.

CPC ..... *E21B 10/56* (2013.01); *E21B 10/567* (2013.01); *E21B 10/5673* (2013.01)

(58) Field of Classification Search

CPC .... E21B 10/46; E21B 2010/545; E21B 10/55; E21B 10/56; E21B 2010/562; E21B 10/5673; E21B 2010/563; E21B 10/5676

See application file for complete search history.

(56) References Cited

U.S. PATENT DOCUMENTS

| | | | | |
|---|---|---|---|---|
| 5,706,906 | A * | 1/1998 | Jurewicz | E21B 10/5673 175/428 |
| 5,881,830 | A * | 3/1999 | Cooley | 175/428 |
| 5,967,246 | A * | 10/1999 | Caraway | E21B 10/003 175/393 |
| 6,009,963 | A * | 1/2000 | Chaves | 175/432 |
| 2004/0003925 | A1* | 1/2004 | Desai | 166/313 |
| 2011/0259642 | A1* | 10/2011 | DiGiovanni | B24D 18/00 175/57 |

* cited by examiner

*Primary Examiner* — Cathleen R Hutchins

(57) ABSTRACT

A cutting element for use with a bit may include an obtuse cutting edge. The cutting edge may be formed between a cutting face and a slanted face of the cutting element. The obtuse cutting edge may be pre-formed in the cutting element for use with a bit used to mill a window in casing and/or drill a deviated borehole. The cutting element may be positioned on the bit as a trailing cutting element, and oriented to cause the obtuse cutting edge to engage casing and/or a rock formation.

19 Claims, 10 Drawing Sheets

CUTTING ELEMENTS AND BITS FOR SIDETRACKING

CROSS-REFERENCE TO RELATED APPLICATIONS

This application claims priority to, and the benefit of, U.S. Patent Application Ser. No. 62/078,025, filed on Nov. 11, 2014, which application is expressly incorporated herein by this reference in its entirety.

BACKGROUND

In exploration and production operations for natural resources such as hydrocarbon-based fluids (e.g., oil and natural gas), a wellbore may be drilled into a subterranean formation. If the wellbore comes into contact with a fluid reservoir, the fluid may then be extracted. In some cases, a primary wellbore may be drilled, and additional, deviated boreholes may be formed to extend laterally or at another incline from the primary wellbore. For instance, another wellbore may be drilled to the downhole location of an additional fluid reservoir or to increase production from a fluid reservoir. In creating the deviated borehole, a whipstock may be employed in a method referred to as sidetracking.

A whipstock may have a ramp surface that guides a mill away from a longitudinal axis of the primary wellbore. To create the deviated borehole, the whipstock can be set at a desired depth and the ramp surface oriented to provide a particular trajectory to facilitate a desired drill path. After setting the whipstock, the mill can be moved in a downhole direction and along the ramp surface of the whipstock, and the ramp surface will guide the mill into the casing of a cased wellbore. As the mill is rotated, the mill can grind away the casing and form a window through the casing for access to the surrounding subterranean formation. After formation of the window, the mill can be tripped out of the primary wellbore, and a drill bit can be tripped into the primary wellbore, through the window, and rotated to drill the subterranean formation and follow a desired trajectory.

SUMMARY OF THE DISCLOSURE

Systems and methods of the present disclosure may relate to cutting elements, bits, sidetracking systems, and methods of manufacturing a bit and/or drilling a deviated borehole. In one embodiment, a cutting element may include a cutting face, a slanted face, and an obtuse cutting edge at an interface between the cutting face and the slanted face.

In accordance with another embodiment of the present disclosure, a bit may include a bit body. The bit body may include blades and leading cutting elements coupled to the blades. Trailing cutting elements may also be coupled to the blades. The trailing cutting elements may include cutting elements with obtuse cutting edges.

According to another embodiment, a method for manufacturing a bit may include orienting leading cutting elements on a blade of the bit. Trailing cutting elements may also be oriented on the blade of the bit in a way that configures an obtuse cutting edge of the trailing cutting elements to contact a workpiece during a cutting operation. The leading and/or trailing cutting elements may be secured to the bit.

In still another embodiment, a method for drilling a deviated borehole may include positioning a deflection member within a wellbore. A mill-drill bit may be guided by the deflection member toward casing within the wellbore, and a window may be milled in the casing using trailing cutting elements of the mill-drill bit. A deviated borehole extending from the wellbore may be drilled using leading cutting elements of the mill-drill bit.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the disclosure or the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each potential embodiment encompassed by the claims or the disclosure, various embodiments will be described and explained with additional specificity and detail through the use of the accompanying drawings in which:

FIGS. 5-1 to 5-4 are various views of a cutting element having an obtuse cutting edge, in accordance with one or more embodiments of the present disclosure;

FIGS. 6-1 to 6-4 are various views of a cutting element having an obtuse cutting edge, in accordance with one or more embodiments of the present disclosure;

FIGS. 7-1 to 7-4 are various views of a cutting element having an obtuse cutting edge, in accordance with one or more embodiments of the present disclosure;

FIGS. 8-1 to 8-4 are various views of a cutting element having an obtuse cutting edge, in accordance with one or more embodiments of the present disclosure;

DETAILED DESCRIPTION

In accordance with some aspects of the present disclosure, embodiments herein relate to cutting elements, bits, downhole tools, systems, and methods for milling and/or drilling. More particularly, embodiments disclosed herein may relate to cutting elements for milling, cutting elements for drilling, milling systems, drilling systems, combined milling/drilling systems, and assemblies and methods for forming a deviated borehole using a downhole tool. More particularly still, embodiments disclosed herein may relate to devices, tools, systems, assemblies, and methods for forming a deviated borehole using a downhole motor. In still other or additional embodiments, devices, tools, assemblies, systems, and methods may be used for setting a whipstock or other deflection member and forming a deviated borehole in a single trip.

Figure 1:
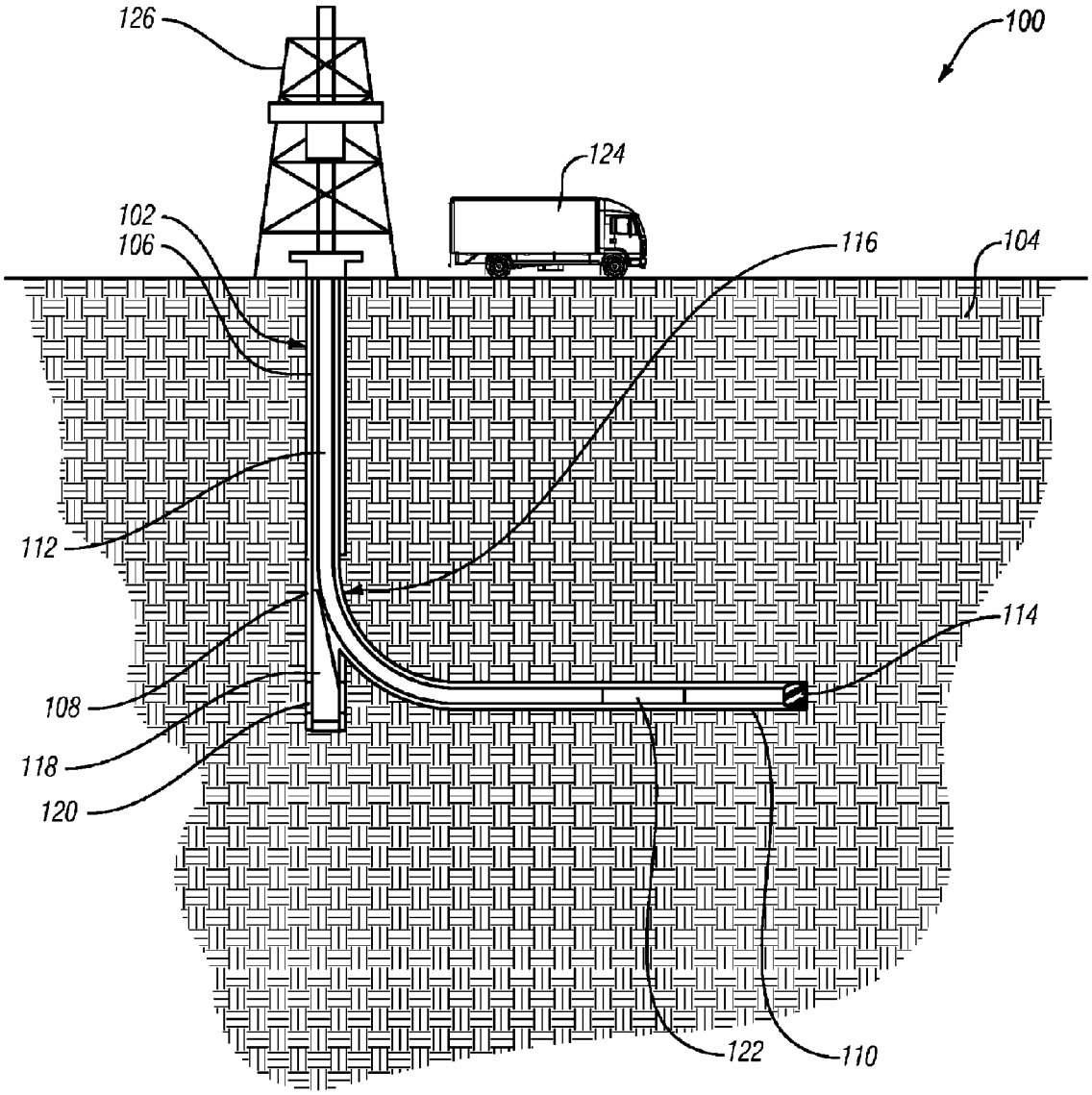
FIG. 1 schematically illustrates an example sidetracking system for forming a deviated borehole, in accordance with one or more embodiments of the present disclosure.

Referring now to FIG. 1, a schematic diagram is provided of an example drilling system 100 that may utilize cutting elements, bits, systems, assemblies, and methods in accordance with one or more embodiments of the present disclosure. FIG. 1 shows an example primary wellbore 102 formed in a formation 104 and having casing 106 installed therein. In some embodiments, the primary wellbore 102 may also include an openhole section lacking a casing 106, or multiple sections or types of casing may be used. Where casing 106 is included, the casing 106 may be cemented or otherwise secured in place within the primary wellbore 102.

In the particular embodiment illustrated in FIG. 1, a sidetracking system 108 may be provided to allow drilling of a lateral or deviated borehole 110 off the primary wellbore 102. The deviated borehole 110 may be drilled using a drill string 112 that is illustrated as including one or more tubular members coupled to a bottomhole assembly ("BHA") that includes or is coupled to a bit 114. The tubular member(s) of the drill string 112 may have any number of configurations. As an example, the drill string 112 may include coiled tubing, segmented drill pipe, or the like. As used herein, a wellbore or primary wellbore refers to an existing well, bore, or hole from which a lateral or deviated borehole is formed. In some embodiments, a wellbore may itself be a deviated borehole.

The bit 114 attached to, or included in, the BHA may be used, in some embodiments, to mill a window 116 in the casing 106 and/or to drill into the formation 104 surrounding the primary wellbore 102 in order to drill the deviated borehole 110. In this particular embodiment, the bit 114 may be configured to operate as a drill bit for drilling into the formation 104. In the same or other embodiments, the bit 114 may be configured to also operate as a mill for milling or otherwise forming the window 116 in the casing 106. In some embodiments, the bit 114 may be configured to operate as a mill and as a drill bit, thereby performing as a mill-drill bit. Optionally, a mill-drill bit may be capable of drilling and steering ahead. For instance, after milling the window with suitable steering motors or tools, the bit 114 can continue to be rotated to drill the formation 104.

To further facilitate formation of the deviated borehole 110 of FIG. 1, the sidetracking system 108 may include a deflection member 118. In some embodiments, the deflection member 118 may include a taper, or a ramped or inclined surface for engaging the bit 114 and guiding and directing the bit 114 into the formation 104 and/or the casing 106. The deflection member 118 may be anchored or otherwise maintained at a desired position and orientation in order to deflect the bit 114 at a desired trajectory. In one embodiment, for instance, the deflection member 118 is a whipstock having a set of anchors 120 coupled thereto. The anchors 120 may define a setting assembly for engaging the sidewalls of the casing 106 around the primary wellbore 102. In other embodiments, the anchors 120 may be configured to engage the sidewalls of an openhole portion of the primary wellbore 102. According to some embodiments, the anchors 120 may be expandable. For instance, hydraulic fluid (not shown) may be used to expand the anchors 120, which may be in the form of expandable arms, expandable slips. The anchors 120 may expand from a retracted position an expanded position. In the retracted position, the deflection member 118 may be able to move axially and/or rotationally within the primary wellbore 102, whereas in the expanded position, the anchors 120 may engage the sidewalls of the primary wellbore 102, and may potentially restrict axial and/or rotational movement of the deflection member 118. The anchors 120 may optionally have a relatively large ratio of the expanded diameter relative to the retracted diameter, thereby facilitating engagement with a sidewall of the primary wellbore 102 and/or casing 106, and potentially engagement with wellbores having any number of different sizes. In other embodiments, the anchors 120 may be supplemented with, or replaced by, other suitable components usable to secure the deflection member 118 in place.

The particular structure of the sidetracking system 108 may be varied in any number of manners. For instance, while the whipstock shown as the deflection member 118 may be set hydraulically, the deflection member 118 may be set in other manners, including mechanically. Moreover, while the deflection member 118 is shown as having a ramped, tapered, inclined, or other guide surface having a relatively constant slope, the slope may vary. For instance, two, three, four, or more sections of the guide surface may have different slopes relative to adjacent sections. Additionally, the guide surface may be planar; however, the guide surface of the deflection member 118 may actually be concave in some embodiments. A concave surface may, for instance, accommodate a rounded or otherwise contoured shape of the bit 114 and/or the drill string 112. In the same or other embodiments, the guide surface of the deflection member 118 may have multiple tiers or sections, or may otherwise be configured or designed.

In accordance with at least some embodiments of the present disclosure, the drill string 112 may include any number of different components or structures. In some embodiments, the drill string 112 may include a BHA with a downhole motor 122. Example downhole motors may include positive displacement motors, mud motors, electrical motors, turbine-driven motors, or some other type of motor that may be used to rotate the bit 114 or another rotary component. For instance, fluid may flow through the drill string 112 and into the downhole motor 122. The downhole motor 122 may convert hydraulic fluid flow and/or fluid pressure into rotary motion using a rotor and a stator, blades and vanes, or any other suitable components or features. A drive shaft (not shown) of the downhole motor 122, or coupled to the downhole motor 122, and within the BHA, may be directly or indirectly coupled to the bit 114. As the drive shaft rotates, the bit 114 may also be rotated. In some embodiments, the downhole motor 122 may include a bent housing or bent sub to steer the BHA. Optionally, the bent housing or bent sub may be used in a slide drilling operation. In some embodiment, the downhole motor 122 may be locked.

The BHA may include additional or other components, including directional drilling and/or measurement equipment. As an example, the BHA may include a steerable drilling assembly to control the direction of drilling of the deviated borehole within the formation 104. A steerable drilling assembly may include various types of directional control systems, including rotary steerable systems such as those referred to as push-the-bit systems, point-the-bit systems, hybrid push and point-the-bit systems, or any other type of rotary steerable or directional control system.

The sidetracking system 108 may also include still other or additional components. By way of example, the sidetracking system 108 may include one or more sensors, measurement devices, logging devices, or the like. Example sensors within the drilling system 100 may include logging-while-drilling ("LWD") and measurement-while-drilling ("MWD") components, rotational velocity sensors, pressure sensors, cameras or visibility devices, proximity sensors, other sensors or instrumentation, or some combination of the foregoing.

In one example, the BHA may include a set of one or more sensors that may be used to detect the position and/or orientation of the bit 114, the deflection member 118, the BHA, or some combination of the foregoing. In additional or other embodiments, the sensors may detect information about the formation 104 (e.g., material, porosity, density, etc.), the drill string 112 (e.g., rotational speed, material wear or damage, etc.), the motor 122 (e.g., rotational speed, fluid flow, efficiency, etc.), the bit 114 (wear, weight-on-bit, rotational speed, temperature, etc.), the BHA (e.g., rate of penetration, etc.), fluid within the primary wellbore 102 or deviated borehole 110, fluid within the drill string 112, other components, or some combination of the foregoing.

In some embodiments, the sensors may provide information used to anchor the deflection member 118, mill the window 116 (e.g., control rotational speed and/or weight-on-bit), or drill the deviated borehole 110 (e.g., control rotational speed, weight-on-bit, direction, etc.), and such information may be used in a closed loop control system. For instance, pre-programmed logic may be used to allow the sensors or other components of the sidetracking system 108 to automatically steer the BHA, and thus the bit 114, when creating the window 116 and/or the deviated borehole 110. In some embodiments, the BHA may include one or more downhole processors, controllers, memory devices, or the like for use in a closed-loop control system. In other embodiments, however, the control system may be an open loop control system. Information may be provided from the sensors to a controller or operator remote from the BHA (e.g., at the surface). The controller or operator may review or process data signals received from the sensors and provide instructions or control signals to the control system to direct use of the sidetracking system 108. The sensors may therefore also include or be communicatively coupled to controllers, positioned downhole or at the surface, configured to vary the operation of (e.g., steer) the bit 114 or other portions of the BHA. Mud pulse telemetry, wired drill pipe, fiber optic coiled tubing, wireless signal propagation, or other techniques may be used to send information to or from the surface.

In FIG. 1, information obtained about the sidetracking system 108 may be provided to an operations center 124, which is here illustrated as a mobile operations center. In other embodiments, however, an operations center may be fixed. For instance, the illustrated embodiment of a drilling system 100 may include a rig 126 used to inject or otherwise convey the drill string 112 into the primary wellbore 102. A command or operations center, or other controller, may be at a relatively fixed location, such as on the rig 126. Optionally, the operations center 124, whether fixed or mobile, and whether local or remote relative to the primary wellbore 102, may include a computing system that includes a controller to receive and process the data transmitted uphole by the BHA. Further, while the rig 126 is shown as a land rig, the drilling system 100 may, in other embodiments, use other types of rigs or systems, including offshore rigs.

In accordance with one or more embodiments of the present disclosure, the deflection member 118 and the bit 114 may be deployed into the primary wellbore 102 in separate trips. For instance, the deflection member 118 may be attached to a drill string and tripped into the primary wellbore 102. Upon anchoring the deflection member 118, the drill string may release or be released from the deflection member 118 and be removed from the primary wellbore 102. Thereafter, the bit 114 used to drill the deviated borehole 110 and/or mill the window 116 in the casing 106 may be tripped into the primary wellbore 102.

Figure 2:
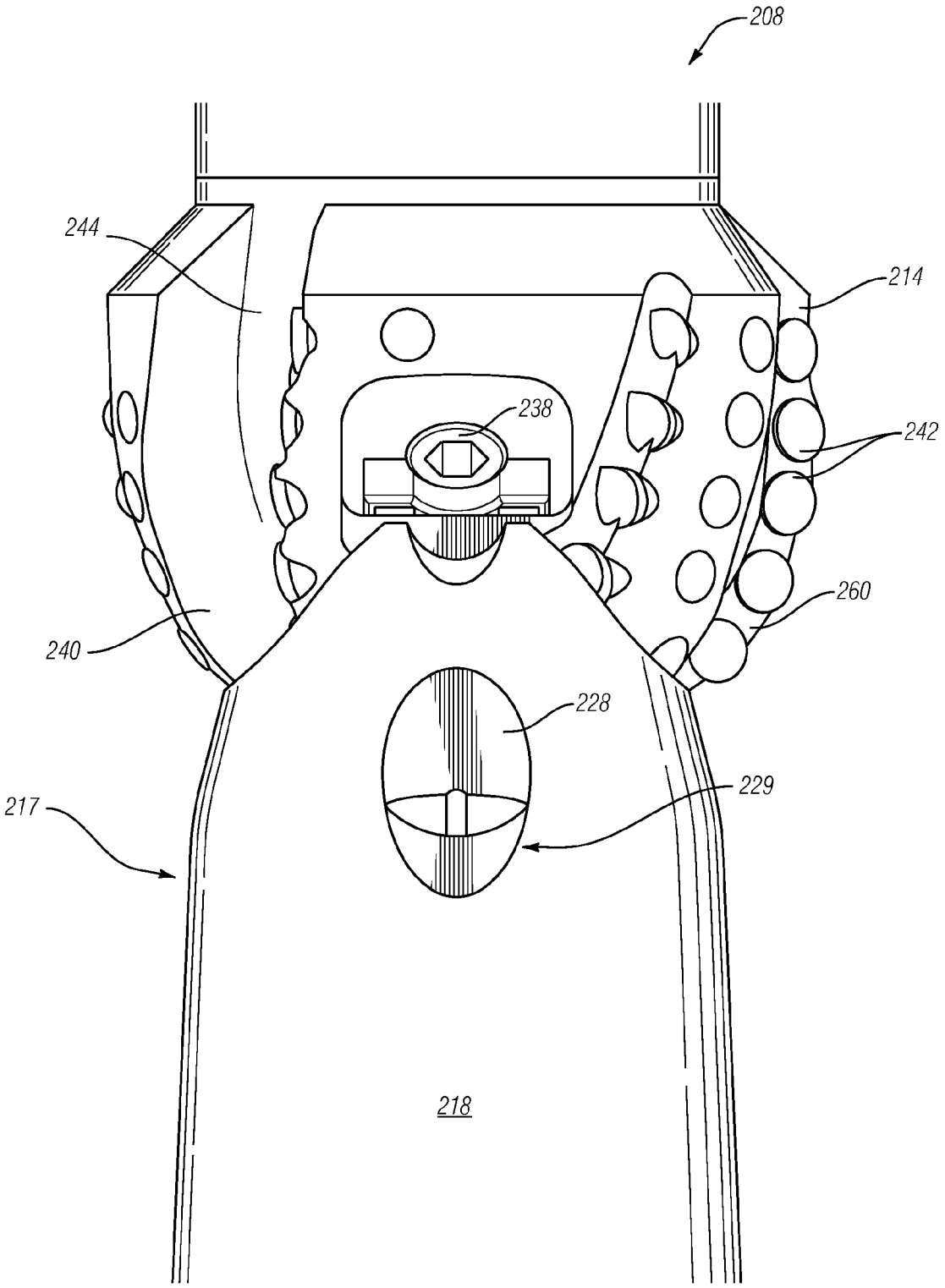
FIG. 2 is a side view of a sidetracking assembly for drilling a deviated borehole, in accordance with one or more embodiments of the present disclosure.
Figure 3:
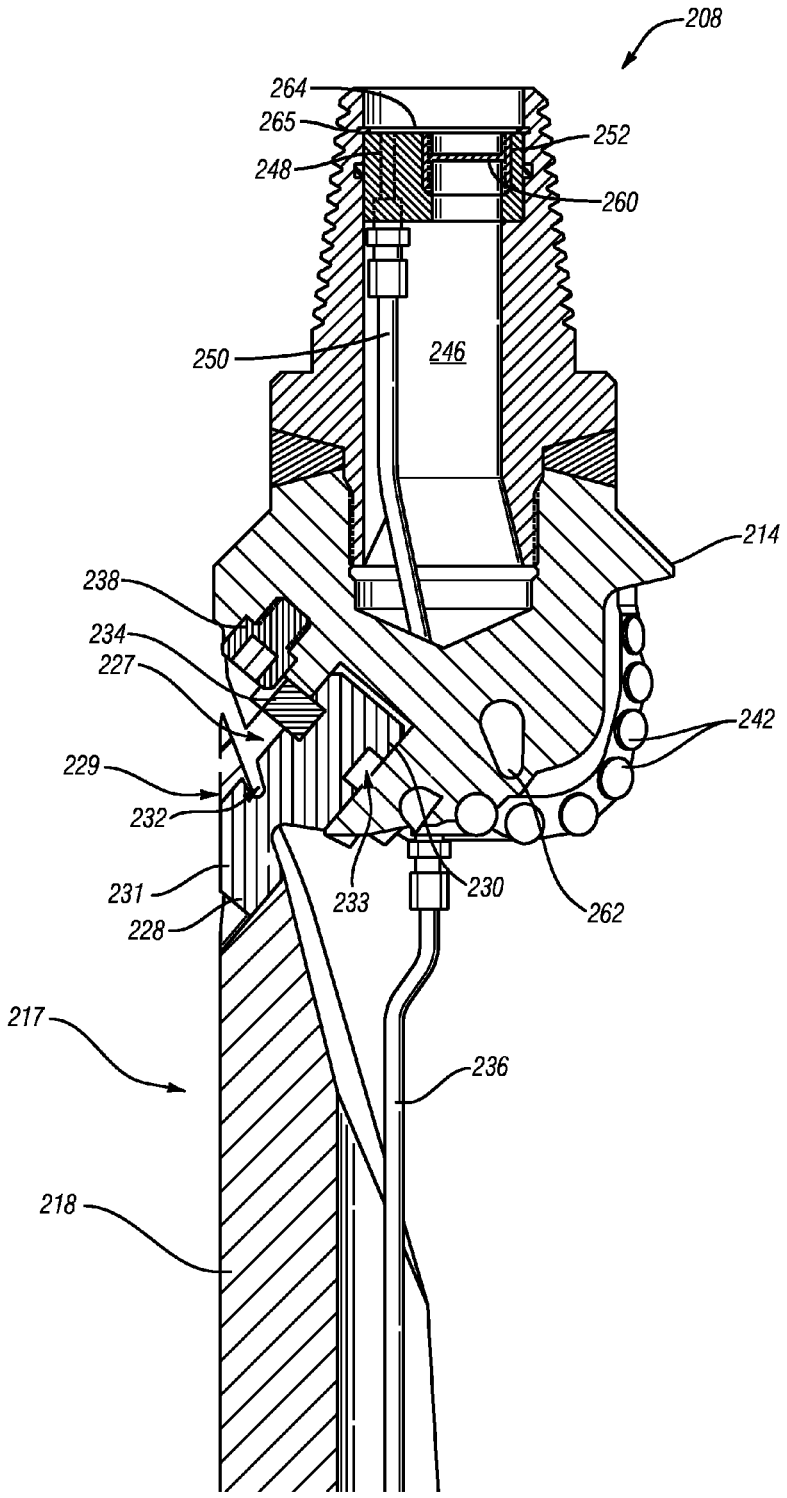
FIG. 3 is a cross-sectional side view of the sidetracking assembly illustrated in FIG. 2, in accordance with one or more embodiments of the present disclosure.

In accordance with one or more embodiments of the present disclosure, the deflection member 118 and the bit 114 may be deployed into the primary wellbore 102 to drill at least portion of the window 116 and/or the deviated borehole 110 in a single trip. FIGS. 2 and 3 illustrate an example embodiment of a sidetracking assembly 208 that may be used for single trip formation of a window and/or a deviated borehole.

In particular, the sidetracking assembly 208 of FIGS. 2 and 3 may generally be used to drill a deviated borehole in a single trip, and includes a drill bit 214 coupled to a whipstock assembly 217 that includes a whipstock 218 or other deflection member. The drill bit 214 may also include a recess or recessed region 227 for receiving a connector 228. The connector 228 may include, or be formed as, a notched pin or bolt, extending between the recessed region 227 in the drill bit 214 and a recess or opening 229 in the whipstock 218. The connector 228 may be configured to releasably couple the drill bit 214 to the whipstock 218. In the illustrated example, the connector 228 may include an attachment base 230 received in a recessed region 227 and an attachment head 231 received in the opening 229 of the whipstock 218. The connector 228 also may also include one or more notches 232 located at a base of the attachment head 231, generally between the whipstock 218 and an outer surface of a cutting end or face of the drill bit 214, as illustrated in FIG. 3. In some embodiments, the connector 228 may be configured to shear or otherwise break at the one or more notches 232, thereby releasing the coupling of the connector 228 between the drill bit 214 and the whipstock 218.

In some embodiments, along the attachment base 230, a groove 233 may be formed to receive a retainer 234, such as a retainer plate. The retainer 234 may secure the connector 228 within the recessed region 227 of the drill bit 214. The retainer 234, in turn, may be secured in engagement with the connector 228 by a locking member 238, such as a bolt/locking screw threadably received in the body of the drill bit 214.

The actual size and configuration of the connector 228 may vary according to the specifics of a particular operation and/or environment. In some embodiments, however, the connector 228 may be secured to an upper portion of the whipstock 218 by welding. The attachment head 231 of the connector 228 may be received within the opening 229 such that the connector 228 protrudes at an angle a few inches above the upper end of the whipstock 218. The connector 228 may subsequently be welded, threaded, or otherwise secured in place. In some embodiments, the connector 228 may be secured to the drill bit 214 between a pair of blades 240, but below one or more cutting elements 242 (e.g., below cutting elements 242 on a gauge of the drill bit 214). Coupling the whipstock 218 to the drill bit 214 below the cutting elements 242 on the gauge of the drill bit 214 may help to ensure that the entire assembly gauges properly.

When the whipstock 218 is anchored/secured in the primary wellbore (e.g., by anchors 120 of FIG. 1 after orienting the sidetracking assembly at a desired depth and azimuth), the connector 228 may break at the one or more notches 232 if the drill bit 214 is subsequently pulled-up with sufficient force. The orientation of the whipstock 218 may be based on a desired trajectory for drilling of a deviated borehole. In another embodiment, the connector 228 may be broken by setting weight down on the drill bit 214 or rotating the drill bit 214 relative to the whipstock assembly 217. The connector 228 may be configured to shear or otherwise break or separate at a force that is less than the holding capacity of an anchor coupled to the whipstock 218.

The one or more notches 232 may be positioned and configured to shear the connector 228 generally flush or nearly flush with the whipstock 218 so as to leave minimal, if any, protrusion of the remaining portion of the connector 228 from the opening 229 (i.e., protruding off the face of the whipstock 218) after shearing. Thus, the one or more notches 232 may be designed to sever the connector 228 not at a right angle but at an angle that is similar to (or approaches) the slope angle/profile of the whipstock 218. Likewise, the shearing of the connector 228 may be configured to leave the remainder of the connector 228 coupled to the drill bit 214 generally at or below the profile of at least a portion of the cutting structure. The remainder of the connector 228 coupled to the drill bit 214 may be securely retained in the recessed region 227 of the drill bit 214. In some embodiments, the drill bit 214 may be securely retained in the drill bit 214, so that once milling is initiated (e.g., milling of casing), a very minimal portion (if any) of the connector 228 remaining coupled to drill bit 214 may be milled away before or during the milling operation (e.g., cutting a window through the casing). The remaining portion of the connector 228 protruding from the opening 229 may be less than that portion of the connector 228 that remains within the opening 229 of the whipstock 218 or that remains within the cutting profile of the drill bit 214. As a result of this configuration, the torque for milling any portion of the connector 228 may be lower and the damage to the cutting elements 242 may be minimized. Additionally, the design may allow the tool face for milling the window through the casing to be maintained for departing more easily into the surrounding formation.

In the illustrated embodiment, the drill bit 214 is illustrated as a fixed cutter bit, although bottomhole assemblies, milling systems, drilling systems, and other systems, assemblies, methods, and tools of the present disclosure may be used in connection with a variety of types of mills, drill bits, or the like. In this particular embodiment, the drill bit 214 may include a plurality of blades 240, each of which may have one or more cutting elements 242. The cutting elements 242 may include cutters, inserts, hardfacing, surface treatments, or the like configured to mill a window through casing and/or drill a deviated borehole within a formation. As discussed in more detail herein, the cutting elements 242 may, in some embodiments, be fixed cutting elements configured to act as shear cutters, and may be formed of materials suitable for shearing the surrounding casing, cement, formation, or other materials (e.g., superhard or superabrasive materials). The blades 240 may each be arranged circumferentially around the drill bit 214 and separated by a set of junk slots or other junk channels 244 to facilitate removal of the cuttings. One or more outlet nozzles 262 may also be located at or near the cutting face or other distal end portion of the drill bit 214 to direct drilling fluid downwardly to further assist in removing of cuttings from the face of the drill bit 214 and/or cooling the drill bit 214 or the cutting elements 242.

The drill bit 214 may include a generally hollow interior having a primary flow passage 246 for conducting fluid, e.g. drilling fluid, to the outlet nozzles 262. Additionally, a bypass port 248 may be connected to a secondary flow passage 250, which may direct a secondary flow of fluid to a hydraulic line 236 coupled between a face of the drill bit 214 and the whipstock 218. The hydraulic line 236 may be employed to convey hydraulic fluid and pressure to an anchor (e.g., anchor 120 of FIG. 1) to enable actuation of the anchor. In one example, the hydraulic line 236 may be engaged with a port (not shown) formed in the whipstock 218 to deliver a pressurized fluid along a passage (not shown) through the whipstock 218 to the anchor.

Referring again to FIG. 3, a rupture disk assembly 252 having a rupture disk 260 may be positioned at an entrance of the primary flow passage 246. The rupture disk 260 may restrict, and potentially prevent, fluid from flowing through the primary flow passage 246 within the drill bit 214 to the annulus, thereby also isolating the pressure in the flow passage above the rupture disk 260 from the annulus. By way of example, the rupture disk 260 may be threaded into a manifold 264 held in place by a retainer 265, such as a snap ring. The bypass port 248 may extend through the manifold 264 for enabling pressure to be communicated to the hydraulic line 236 and through the whipstock 218. In some embodiments, the hydraulic line 236 may include a hydraulic hose connected into one of the outlet nozzles 262. The other outlet nozzles 262 may be left open and may not include break-off plugs because of the use of the rupture disk assembly 252. As a result, the cutting elements 242 may be exposed to a reduced amount of shrapnel or other debris from the lack of break-off plugs. The rupture disk assembly 252 is one example of a mechanism for controlling flow, and other types of flow control devices could be used, e.g. other types of frangible members, valves, or other flow control devices suitable for a given application.

The combination of the connector 228 and the hydraulic flow control within the drill bit 214 may reduce potential damage to a cutting end or face of the drill bit 214 by reducing or eliminating milling of a connector, and thereby, reducing debris. Such reductions may also reduce the amount of detrimental vibrations experienced by the drill bit 214, thus facilitating both milling (e.g., of a casing window) and drilling of extended lateral/deviated boreholes into one or more formations during a single trip downhole.

Additionally, the overall structure and configuration of specific components of the drill bit 214 can be used to optimize the milling and/or drilling capabilities of the drill bit 214 according to the specifics of a given application. Adjustments to the cutting structure may include adjustments to cutting element shape/materials, cutting profile of leading cutting elements, trailing cutting element locations, trailing cutting element shape/materials, cutting element back and/or side rake, body profile, body details, numbers of blades, junk slot geometry, other features of the drill bit 214, and combinations of the foregoing. The geometry, material properties, and cutting structure of any additional mills and reamers in a bottomhole assembly, as well as the geometry, configurations, material properties and actions of other drilling assembly components (e.g., downhole motor, whipstock, stabilizers, etc.) can affect the milling and drilling capabilities. Further, the casing geometry and material of construction can also affect the milling and/or drilling capabilities. In operation, the drill bit 214 may be able to mill through, for example, the metal material of casing within a wellbore, and then continue to drill through rock of the surrounding formation in which a deviated borehole is formed/drilled.

While FIGS. 2 and 3 illustrate an example embodiment in which the drill bit 214 may be coupled to the whipstock assembly 217 using the connector 228, a bit may be coupled to another whipstock assembly in other manners, or the drill bit 214 may be replaced by another type of bit or include other features. In some embodiments, for instance, welded connectors, collars, frangible members, or other components may be used in addition to, or in lieu of, the connector 228. In some embodiments, the drill bit 214 may be coupled to steerable components such as bent housings, push-the-bit rotary steerable systems, point-the-bit rotary steerable systems, or the like.

Figure 4:
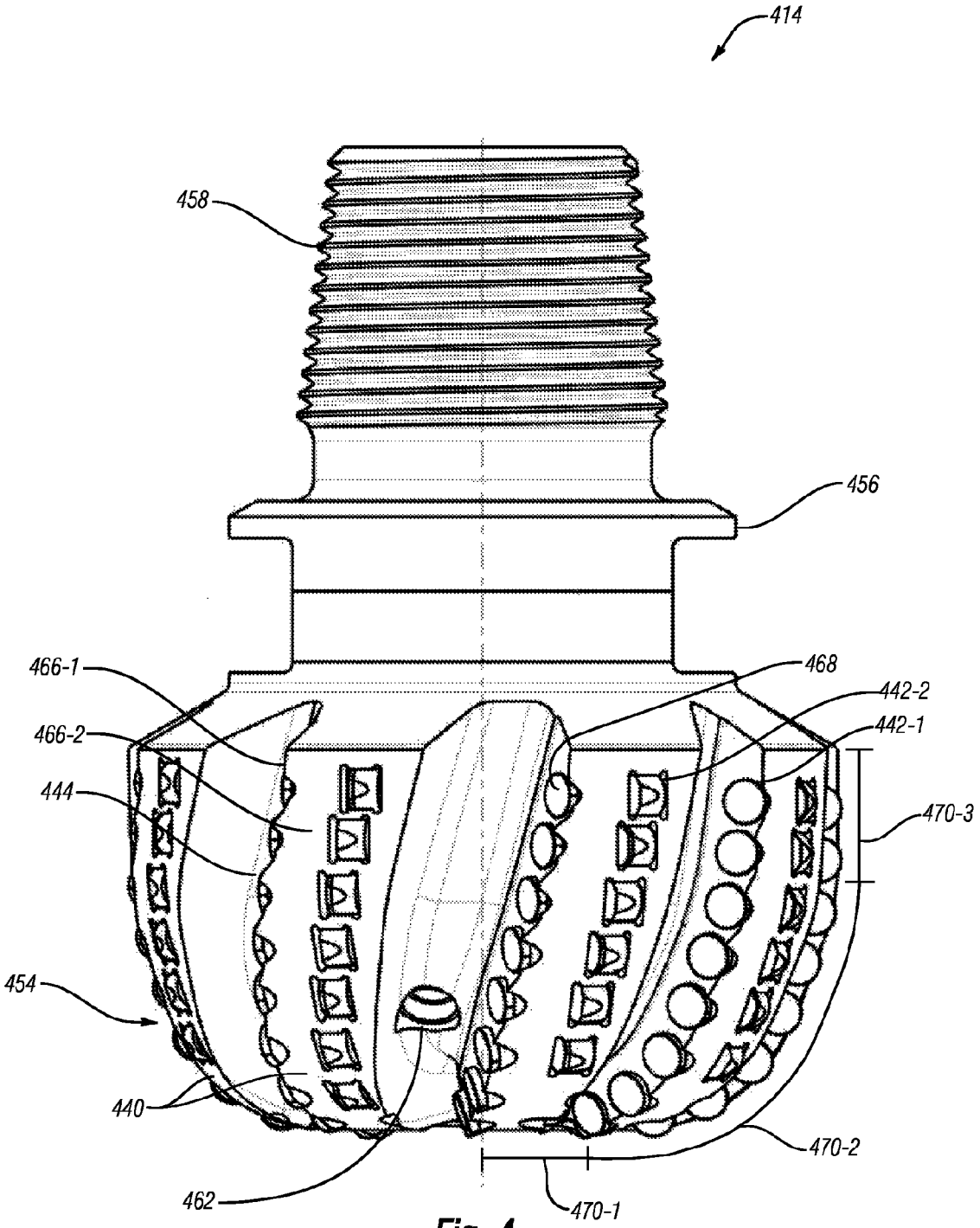
FIG. 4 is a side view of a mill-drill bit having leading and trailing cutting elements, in accordance with one or more embodiments of the present disclosure.

Referring now to FIG. 4, an example bit 414 is shown in additional detail. The bit 414 is a fixed cutter bit (sometimes referred to as a drag bit) and is an example of one type of bit that may be used as a bit in accordance with embodiments disclosed herein (e.g., as bits 114 and 214 of FIGS. 1 and 2, respectively). In some embodiments, the bit 414 may be configured for use in drilling through formations of rock to form a wellbore or borehole. In the same or other embodiments, the bit 414 may also be configured for use in milling through casing or other downhole structures. The bit 414 may, therefore, be a mill-drill bit. In at least some embodiments, the bit 414 may include a bit body 454, a shank 456 and a threaded connection or pin 458 for connecting the bit 414 to a drill string, downhole motor, or other component used to rotate the bit 414. The bit body 454 may include or support cutting structures such as blades 440, which may be on an end of the bit 414 opposite the pin 458. The bit body 454 may be formed in any suitable manner using, for instance, powdered metal tungsten carbide particles in a binder material to form a hard metal cast matrix. In other embodiments, the bit body 454 may be machined from a metal block, such as steel, or formed in other manners.

The bit body 454 may include a central longitudinal bore permitting drilling fluid to flow from the drill string into the bit 414. The body 454 may also include ports or nozzles 462 in direct or indirect fluid communication therewith. The nozzles 462 may serve to distribute drilling fluids around the blades 440 to flush away cuttings during milling and drilling and to remove heat from the bit 414.

The blades 440 may extend radially outward from a longitudinal axis of the bit 414. In this embodiment, the plurality of blades 440 (e.g., primary blades, secondary blades, etc.) may be uniformly angularly spaced around the longitudinal axis. In other embodiments, the blades 440 may be spaced non-uniformly around the longitudinal axis. Moreover, the bit 414 may have any suitable number of primary, secondary, or other blades 440. Between the blades 440 there may be recesses or other areas known as courses, junk channels, or junk slots 444. Fluid, debris, cuttings, and the like may flow from the face of the bit 414, through the junk slots 444, and toward the surface.

Each blade 440 may include a first supporting surface 466-1 for mounting a plurality of leading cutting elements 442-1. In particular, a plurality of leading cutting elements 442-1, each having a cutting face 468, may be mounted to the first supporting surface 466-1 of each blade 440. In some embodiments, a pocket may be formed in the first supporting surface 466-1 to allow the leading cutting elements 442-1 to be inserted therein and coupled to the blades 440. According to some embodiments, trailing cutting elements 442-2 may be coupled to a second supporting surface 466-2 of one or more of the blades 440. Pockets or other support structures may be formed in the second supporting surface 466-2 to allow the trailing cutting elements 442-2 to be inserted therein and coupled to the blades 440.

The leading cutting elements 442-1 may be positioned adjacent one another generally in a first row extending radially along each blade 440. Further, the trailing cutting elements 442-2 may be positioned adjacent one another generally in a second row extending radially along each blade 440. The trailing cutting elements 442-2 may be positioned behind the leading cutting elements 442-1 provided on the same blade 440. As a result, when the bit 414 rotates about a longitudinal axis in a cutting direction, the trailing cutting elements 442-2 trail the leading cutting elements 442-1 provided on the same blade 440. Thus, as used herein, the term "trailing cutting element" is used to describe a cutting element that trails any other cutting element on the same blade when the bit (e.g., bit 414) is rotated in the cutting direction. Further, as used herein, the term "leading cutting element" is used to describe a cutting element provided on the leading edge of a blade. In other words, when a bit is rotated about its central or longitudinal axis in the cutting direction, a "leading cutting element" does not trail any other cutting element on the same blade. As used herein, the terms "leads," "leading," "trails," and "trailing" are used to describe the relative positions of two structures (e.g., two cutting elements) on the same blade relative to the direction of bit rotation.

In general, the leading cutting elements 442-1 and the trailing cutting elements 442-2 need not be positioned in rows, but may be mounted in other suitable arrangements provided each cutting element is either in a leading position or trailing position. Examples of suitable arrangements may include without limitation, rows, arrays or organized patterns, randomly, sinusoidal pattern, or combinations thereof. Further, in other embodiments, additional rows of cutting elements (e.g., additional rows of trailing cutting elements) may be provided on a blade 440.

The blades 440 may be divided into three different regions. A cone region 470-1 may include the most inner or central region of bit 414. In this embodiment, the cone region 470-1 is shown as being concave, but the cone region 470-1 may be planar, convex, have other contours, or include a combination of the foregoing. Adjacent the cone region 470-1 may be a shoulder region 470-2. In this embodiment, the shoulder region 470-2 is shown as being generally convex; however, the shoulder region 470-2 may have other configurations. The transition between the cone region 470-1 and the shoulder region 470-2, which may be referred to as the nose or nose region, may occur at the axially outermost portion of a blade 440, where a tangent line to the blade profile has a slope of zero. Moving radially outward, adjacent the shoulder region 470-2 there may be a gauge region 470-3, which may extends substantially parallel to longitudinal axis of the bit, at the radially outer periphery of the bit body 454. As used herein, the term "full gauge diameter" refers to the outer diameter of the bit defined by the radially outermost reaches of the leading cutting elements 442-1 and the surfaces of the blades 440. In some embodiments, the trailing cutting elements 442-2 may also extend to the full gauge diameter of the bit 414. In other embodiments, the trailing cutting elements 442-2 may not extend radially outward to the full gauge diameter of the bit 414. In still further embodiments, the trailing cutting elements 442-2 may extend radially outward past the full gauge diameter of the bit 414.

According to at least some embodiments of the present disclosure, the leading cutting elements 442-1 and trailing cutting elements 442-2 may be configured to serve different functions. For instance, the leading cutting elements 442-1 may be configured for use in drilling subterranean rock formations, while the trailing cutting elements 442-2 may be configured for use in milling casing or other downhole components. In at last some embodiments, the trailing cutting elements 442-2 may be configured to be used in a milling operation (e.g., window milling operation) that occurs prior to a drilling operation using the leading cutting elements 442-1. In such an embodiment, the trailing cutting elements 442-2 may engage steel casing or the like and form a window, mill a downhole component, or the like. Thereafter (e.g., when drilling a deviated borehole), the leading cutting elements 442-1 may be primarily used for the subsequent operation. Nothing herein should be interpreted as limiting either the leading cutting elements 442-1 or the trailing cutting elements 442-2 to use during a single operation. For instance, during a drilling operation, the trailing cutting elements 442-2 may be used, and during a milling operation, the leading cutting elements 442-1 may be used. In some embodiments, the trailing cutting elements 442-2 may be located beyond the full gauge diameter to facilitate use in a first operation. The trailing cutting elements 442-2 may also wear down to the full gauge diameter (or below the full gauge diameter) to facilitate use of the leading cutting elements 442-1 during a second or subsequent operation. In some embodiments, the leading cutting elements 442-1 may be used during a milling operation.

The primary and/or trailing cutting elements 442-1, 442-2 (collectively cutting elements 442) may be formed of any number of different materials or components. In some embodiments, for instance, the cutting elements 442 may be formed of a cemented carbide material that may be press-fit, brazed, or otherwise coupled to the blades 440. The cutting elements 442 may be cutters or cutting inserts formed by compacting a mixture of carbide particles (e.g., tungsten carbide particles) and a metal binder (e.g., cobalt) within a die. While pressurized, the mixture may be heated for sintering. Such materials may be referred to as superhard or superabrasive materials as they may be highly resistant to abrasive wear.

Cementing tungsten carbide materials with a cobalt binder is merely illustrative of a number of different types of materials that may be formed to create a cutting element 442. For instance, carbides or borides that include tungsten, titanium, molybdenum, niobium, vanadium, hafnium, tantalum, chromium, zirconium, silicon, or other materials (or some combination thereof) may be combined with a binder including cobalt, nickel, iron, titanium, other materials, and alloys thereof. In other embodiments, a cutting element 442 may be formed in other ways (e.g., machining, casting, or otherwise forming tungsten, tool steel, etc.).

Figures 1, 5:
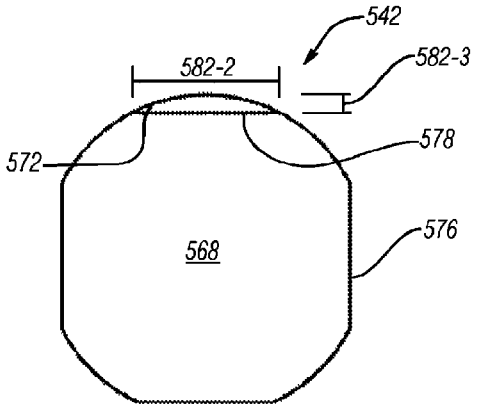
Figures 2, 5:
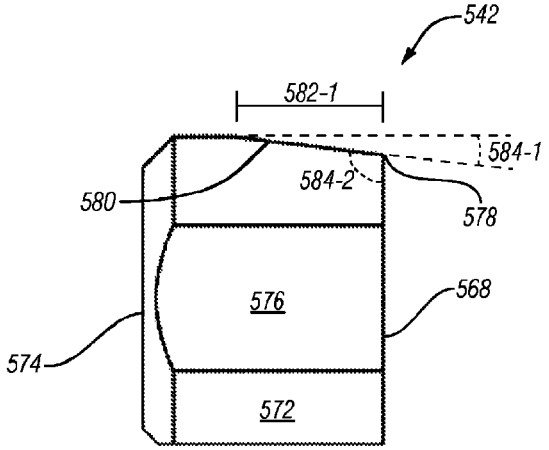
Figures 3, 5:
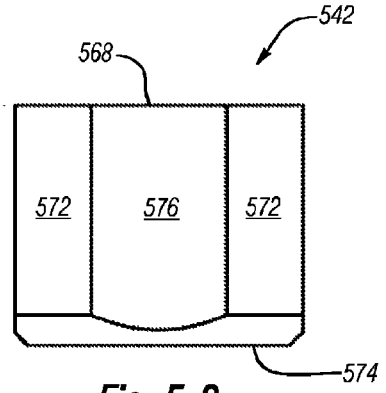
Figures 4, 5:
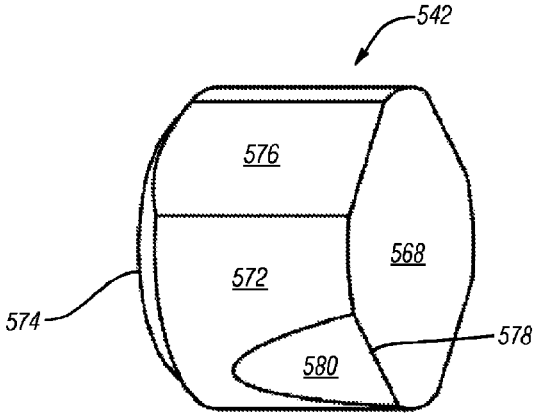

An example of a suitable cutting element that may be used in connection with embodiments disclosed herein is further illustrated in FIGS. 5-1 to 5-4. In particular, the cutting elements shown in FIGS. 5-1 to 5-4 may be used as a trailing cutting element (e.g., trailing cutting element 442-2 of FIG. 4) or as a leading cutting element (e.g., leading cutting elements 442-1 of FIG. 4). In this particular embodiment, a cutting element 542 may have an outer surface 572 extending between a cutting face 568 and a mounting face 574. The mounting face 574 may be configured to be coupled to a bit body (e.g., within a pocket of the blade 440 in FIG. 4). In some embodiments, a taper, bevel, chamfer, or the like may be positioned around the mounting face 574 to facilitate placement of the cutting element 542 in a blade.

According to at least some embodiments of the present disclosure, the cutting face 568 may be planar and/or have a circular or generally circular shape, while the outer surface 572 may be cylindrical or generally cylindrical. As seen in FIG. 5-1, for instance, the cutting face 568 may be generally circular and the outer surface 572 may be generally cylindrical. More particularly, in this embodiment, one or more locating features 576 may be located on the outer surface 572, which may also affect the shape of the cutting face 568. The locating features 576 may include flats, grooves, ridges, recesses, or other features. Such features may correspond to the location of mating features in a pocket or other component of a blade of the bit. By including such features on the cutting element 542 and/or the bit, the cutting element 542 may be easily oriented to ensure a cutting edge 578 of the cutting element 542 is oriented in a desired direction. For instance, the cutting edge 578 may be oriented to be outward and configured to provide a shearing edge for use in engaging and cutting a work material (e.g., casing, rock formation, etc.).

In the particular embodiment shown in FIGS. 5-1 to 5-4, three locating features 576 may be included on the cutting element 542. Such an embodiment is merely illustrative; however, and in other embodiments more or fewer locating features 576 may be used. Moreover, while such locating features 576 are shown as being angularly offset from the cutting edge 578 (see FIGS. 5-1 and 5-4), in other embodiments, locating features 567 and the cutting edge 578 may be positioned at the same angular or circumferential position.

The cutting face 568 may be about perpendicular to the outer surface 572 in some embodiments of the present disclosure, and the cutting edge 578 may be formed around a full periphery of the cutting face 568. In other embodiments, however, the cutting edge 578 may extend around a partial periphery of the cutting face 568. For instance, as seen in FIGS. 5-1 to 5-4, a slanted face 580 may be formed in the outer surface 572, and may extend non-perpendicularly relative to the cutting face 568. In at least some embodiments, an intersection between the slanted face 580 and the cutting face 568 may define the cutting edge 578.

The slanted face 580 may have any number of different configurations and, as a result, the cutting edge 578 formed thereby may also have any number of shapes, features, and the like. For instance, the slanted face 580 may be planar as shown in FIGS. 5-1 to 5-4, but may be curved (e.g., convex or concave), undulating, have a number of other features in other embodiments, or include combinations of the foregoing.

The particular shape of the slanted face 580 may vary based on any number of parameters. For instance, the slanted face 580 of FIGS. 5-1 to 5-4 is shown as being parabolic as the intersection of an inclined plane with a cylinder. The particular length 582-1 and width 582-2 of the slanted face 580 may be dependent on the slope 584-1 of the slanted face 580 and/or the depth 582-3 of the cutting edge 578 relative to the outer surface 572. In one embodiment, for instance, the slope 584-1 of the slanted face 580 relative to a line that is perpendicular to the cutting face 568 may be between 0.5° and 35°. More particularly, the slope 584-1 may be within a range that includes lower and/or upper limits including any of 0.5°, 1°, 2°, 3°, 4°, 5°, 6°, 7°, 8°, 9°, 10°, 12.5°, 15°, 20°, 35°, or values therebetween. In other embodiments, the slope 584-1 may be less than 0.5° or more than 35°.

The depth 582-3 of the slanted face 580 may be measured as the difference between the radius of the outer surface 572 and the distance between the cutting edge 578 and the longitudinal axis of the cutting element 542. In some embodiments, the depth 582-3 may be between 5% and 25% of the radius. More particularly, the depth 582-3 may be, relative to the radius of the outer surface 572, within a range that includes lower and/or upper limits including any of 5%, 7.5%, 10%, 12.5%, 15%, 20%, 25%, and values therebetween. In other embodiments, the depth 582-3 may be less than 5%, or more than 25%, of the radius of the outer surface 572. In some embodiments, the length 582-1 may be between 5% and 100% of the length of the cutting element 542 (i.e., the distance between the cutting face 568 and the mounting face 574). More particularly, the length 582-1 may be within a range that includes lower and/or upper limits including any of 5%, 15%, 25%, 30%, 40%, 50%, 60%, 70%, 75%, 80%, 90%, or 100% of the length of the cutting element 542, or any values therebetween. In still other embodiments, the length 582-1 may be less than 5% of the length of the cutting element 542.

The width 582-2 may also be measured relative to a radius of the cutting element 542 and/or the perimeter of the cutting face 568 or other feature of 542. For instance, the width 582-2 may be between 10% and 150% of the radius of the cutting element 542. More particularly, the width 582-2 may be within a range that includes lower and/or upper limits that include any of 10%, 20%, 35%, 50%, 60%, 70%, 75%, 90%, 100%, 125%, or 150% of the radius of the cutting element 542, or any values therebetween. In still other embodiments, the length 582-1 may be less than 10% or more than 150% of the radius of the cutting element 542. Further still, the width 582-2 may be between 1% and 25% of the circumference or perimeter of the cutting face 568. For instance, the width 582-2 may have a measurement that is within a range having lower and/or upper limits including any of 1%, 5%, 7.5%, 10%, 12.5%. 15%, 17.5%, 20%, or 25% of the perimeter of the cutting face 568. In other embodiments, the width 582-2 may be less than 1% or more than 25% of the perimeter of the cutting face 568.

In still other embodiments, the slanted face 580 may be formed in other manners, or may have different features. For instance, the slanted face 580 may be parabolic, semi-circular, rectangular, frusto-conical, have other shapes, or be a combination of the foregoing.

Regardless of the particular size and/or shape of the slanted face 580, the slanted face 580 (or the cutting edge 578) may be oriented at an angle 584-2 relative to the cutting face 568. In at least some embodiments, the angle 584-2 may be obtuse. For instance, the angle 584-2 may be between 90.5° and 125°. More particularly, the angle 584-2 may be within a range including lower and/or upper limits including any of 90.5°, 91°, 92°, 93°, 94°, 95°, 96°, 97°, 98°, 99°, 100°, 102.5°, 105°, 110°, 125°, or values therebetween. In other embodiments, the angle 584-2 may be less than 90.5° or more than 125°. Where the angle 584-2 is obtuse, the cutting edge 578 may be referred to as an obtuse cutting edge.

According to various embodiments of the present disclosure, when the cutting edge 578 is an obtuse cutting edge, the forces on the cutting element 542 may be reduced during milling of a window in casing, or in another milling or other operation. For instance, the cutting element 542 may be used as a trailing cutting element (e.g., trailing cutting element 442-2 of FIG. 4). The cutting edge 578 may be non-circular and used to shear metal or other casing materials to form a window in the casing. The cutting edge 578 may be specifically configured for milling, and may provide high gauge durability. In particular, while milling, the cutting elements 542 may limit wear of one or more leading cutting elements, thereby allowing them to maintain the full gauge diameter of the bit throughout much of the milling process. In some embodiments, the cutting elements 542 may be configured to wear rapidly when drilling formation after a window is milled. By wearing rapidly after forming the window, the drilling performance may be improved as leading cutting elements (which may not have a cutting edge formed by a slanted face or other sloped surface) may engage the rock formation and use a circular cutting edge, conical, frusto-conical, semi-round top, other cutting element feature, or some combination of the foregoing, configured to cut formation rock. Additionally, while the width 582-2 of the slanted face 572 is shown in FIG. 5-4 as decreasing toward the mounting face 574, in other embodiments, the width 582-2 may remain constant or even increase toward the mounting face 574.

Figures 1, 6:
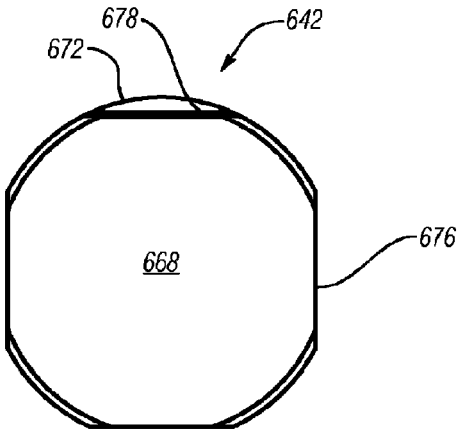
Figures 2, 6:
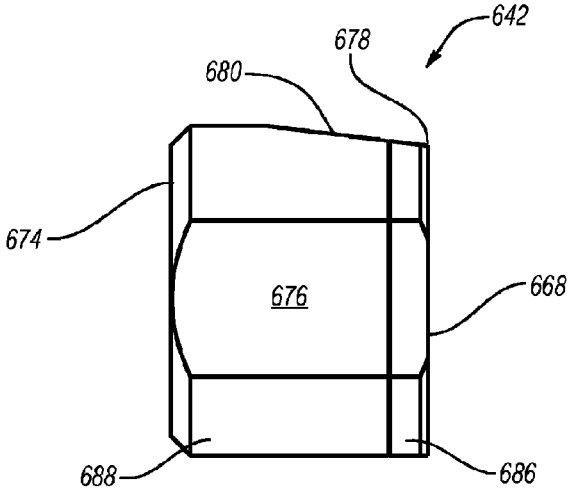
Figures 3, 6:
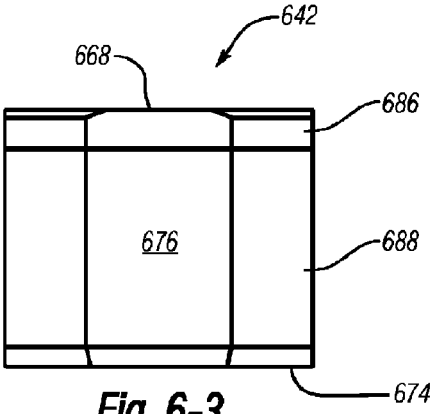
Figures 4, 6:
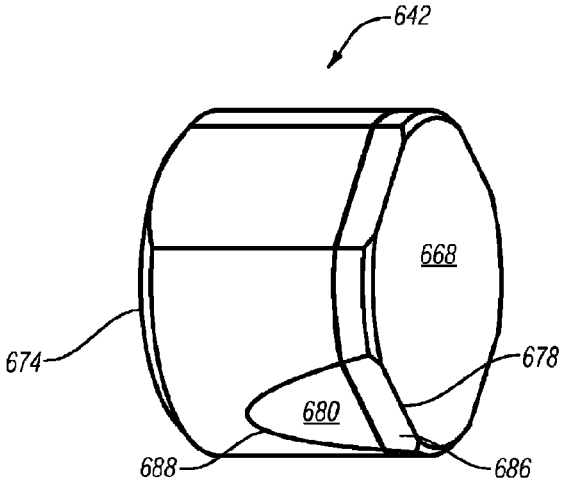

Cutting elements of the present disclosure may be made of any number of different materials. For instance, the cutting elements may include so-called grit hot-pressed inserts formed from hot pressing pelletized diamond grits. The cutting elements may also or otherwise include polycrystalline diamond inserts or polycrystalline cubic boron nitride inserts. The cutting elements may also include additional or other components or materials, and in some embodiments include additional or other superhard or superabrasive materials. In some embodiments, cutting elements of the present disclosure may be formed of multiple materials and/or layers of materials. FIGS. 6-1 to 6-4, for instance, illustrate a cutting element 642 similar to the cutting element 542 of FIGS. 5-1 to 5-4; however, the cutting element 642 is formed of multiple layers of materials. In particular, the cutting element 642 may be a polycrystalline diamond compact ("PDC") or polycrystalline cubic boron nitride ("PCBN") cutting element in some embodiments. In such embodiments, the polycrystalline diamond or cubic boron nitride may be formed as a layer on top of a substrate layer.

PDC, PCBN, or other layered cutting elements may be used for drilling rock and/or milling or otherwise machining metal. A compact of polycrystalline diamond (or other superhard material such as cubic boron nitride) may be bonded to a substrate material to form a cutting element. Example substrate materials may include a sintered metal-carbide such as those discussed above, grit hot-pressed materials, or other substrate materials. Polycrystalline diamond may include a polycrystalline mass of diamonds (which may be synthetic) bonded together to form an integral, tough, high-strength mass or lattice. The resulting polycrystalline diamond structure produces enhanced properties of wear resistance and hardness, making polycrystalline diamond materials useful in aggressive wear and cutting applications. In some embodiments, cutting edges (including obtuse cutting edges), slanted faces, and the like may be formed fully or partially of a single material. In embodiments that include layered cutting elements or other cutting elements with different materials, the cutting edge or slanted face may be formed fully in a single layer/material, or may include multiple layers/materials. For instance, a cutting face may be formed in a polycrystalline diamond layer, but the slanted face may be formed in a polycrystalline diamond layer and a substrate layer. In some embodiments, the slanted face may be formed in a transition layer in addition to one or more of the polycrystalline diamond layer and/or the substrate layer.

A PDC or other layered cutting element may be formed by placing a cemented carbide substrate into the container of a press. A mixture of diamond grains, or diamond grains and catalyst binder, may be placed atop the substrate and treated under high pressure, high temperature conditions. In doing so, metal binder (e.g., cobalt, nickel, etc.) migrates from the substrate and passes through the diamond grains to promote intergrowth between the diamond grains. As a result, the diamond grains become bonded to each other to form the diamond layer, and the diamond layer is in turn bonded to the substrate. The deposited diamond layer may be referred to as the "diamond table" or "abrasive layer." Where the cutting element includes cubic boron nitride in lieu of diamond materials, the deposited layer may be referred to as a "cubic boron nitride table".

Polycrystalline diamond may include, in some embodiments, 85-95% by volume diamond, and a balance of the binder material, which is present in polycrystalline diamond within the interstices existing between the bonded diamond grains. Binder materials used in forming polycrystalline diamond may include cobalt and other Group VIII elements, or other binder materials as discussed herein.

Polycrystalline diamond may be unstable or prone to damage at temperatures above 700° C. due to thermal mismatch between the polycrystalline diamond and the binder material. In order to overcome such a mismatch, strong acids may be used to "leach" the binder from the diamond lattice structure (either a thin volume or entire tablet) to at least reduce the damage experienced from heating diamond-binder composite at different rates upon heating. A strong acid (e.g., nitric acid) or combinations of several strong acids (e.g., nitric and hydrofluoric acid) may be used to treat the diamond table, removing at least a portion of the co-catalyst from the PDC composite. By leaching out the binder, thermally stable polycrystalline ("TSP") diamond may be formed. In certain embodiments, a select portion (rather than a full portion) of a polycrystalline diamond composite may be leached, in order to gain thermal stability without losing impact resistance. Interstitial volumes remaining after leaching may be reduced by either furthering consolidation or by filling the volume with a secondary material. While the description above describes a process for forming a PDC cutting element, a similar process may be used for forming a PCBN cutting element.

In FIGS. 6-1 to 6-4, the cutting element 642 may be formed as discussed herein, and may include a diamond table 686 bonded to a substrate 688. In particular, in this embodiment, the diamond table 686 may include a cutting edge 678 and cutting face 668 of the cutting element 642, while the substrate 688 may include a mounting face 674 of the cutting element 642. Optionally, the cutting edge 678 (or a full or partial periphery of the cutting face 668) may include a chamfer, bevel, or other feature thereon.

As seen in FIG. 6-4, both the diamond table 686 and the substrate 688 may make up portions of the slanted face 680 of the cutting element 642. In other embodiments, the slanted face 680 may be made up wholly of the diamond table 686, or without any portion of the substrate 688. In still other embodiments, opposing sides of the diamond table 686 may each be bonded to a substrate 688, such that the cutting edge 676 and cutting face 668 may be formed of the substrate 668. In the same or other embodiments, one or more transition layers may be formed between the diamond table 686 and the substrate 688.

The shapes, features, and dimensions of the cutting element 642 may be similar to those discussed previously with respect to the cutting element 542 of FIGS. 5-1 to 5-4. Accordingly, in some embodiments of the present disclosure, the cutting edge 678 may be an obtuse cutting edge. The cutting face 680 may be sloped relative to the outer surface 672 of the cutting element 642 to form the obtuse cutting edge 678. Optionally, one or more locating features 676 may be formed in the outer surface 672. Such locating features 676 may take any suitable form, and in this embodiment may be formed as planar surfaces that give the generally cylindrical outer surface 672 the form of a rounded square. As shown in FIG. 6-1, there may be multiple locating features 676, although there may also be a single locating feature 676, or no locating features 676. In the illustrated embodiment, three locating features 676 offset at ±90° and 180° from the cutting edge 678. In this particular embodiment, there is not a locating feature 676 angularly or circumferentially aligned with the cutting edge 678. As a result, FIG. 6-1 illustrates that a portion of the outer surface 672 angularly aligned with the cutting edge 678 optionally remains curved. In this embodiment, the cutting edge 678 is shown as having a convex curve relative to the exterior of the cutting element 642; however, in other embodiments the cutting edge 678 may be concavely curved.

Figures 1, 7:
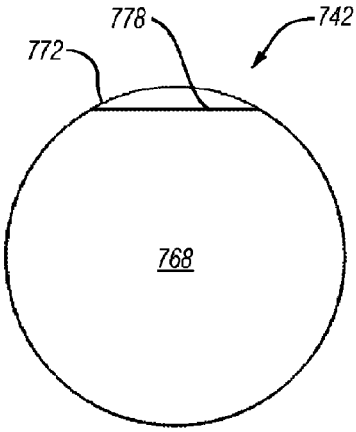
Figures 2, 7:
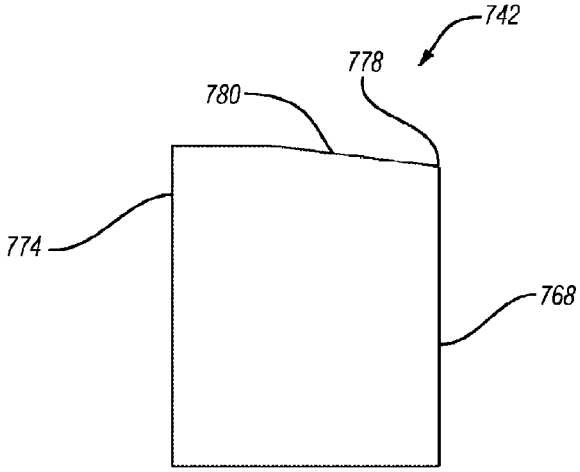
Figures 3, 7:
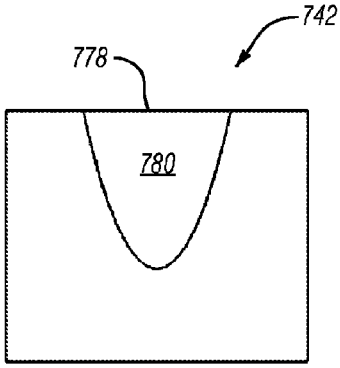
Figures 4, 7:
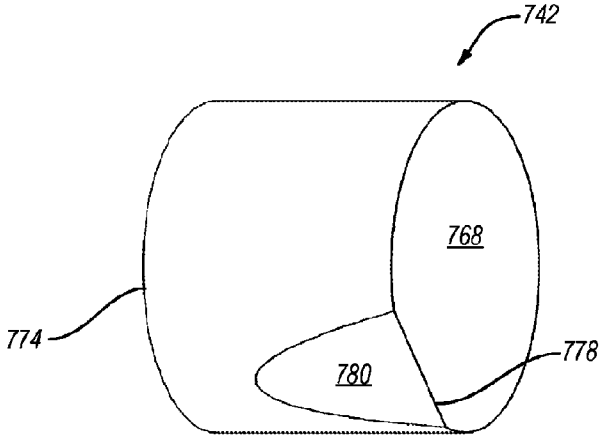

In still other embodiments, however, one or more of the locating features 676 may be removed. FIGS. 7-1 to 7-4, for instance, illustrate an example cutting element 742 according to embodiments of the present disclosure. The illustrated cutting element 742 may not include locating features, and may instead have a cylindrical outer surface 772. In this embodiment, the cutting element 742 may include a cutting edge 778 formed at an intersection between a slanted face 780 and a cutting face 768. The slanted face 780 may be oriented at an angle that is non-perpendicular relative to the cutting face 768. In some embodiments, an obtuse angle may be defined between the cutting face 768 and the slanted face 780; however, in other embodiments an acute angle may be defined.

The slanted face 780 may have any suitable shape or configuration, and in FIGS. 7-3 and 7-4 is shown as being generally parabolic, such that the slanted face 780 has a larger width at the cutting edge 778 and decreases in width toward the mounting face 774. In other embodiments, however, the slanted face 780 may have a relatively constant width, or increase in width, toward the mounting face 774. The slanted face 780 may extend partially or fully between the cutting face 768 and the mounting face 774. As shown in this embodiment, the mounting face 774 may optionally not be tapered, beveled, or chamfered; however, such an embodiment is merely illustrative and a chamfer, taper, bevel, or other structure may be provided in other embodiments (see FIGS. 5-1 to 6-4).

Figures 1, 8:
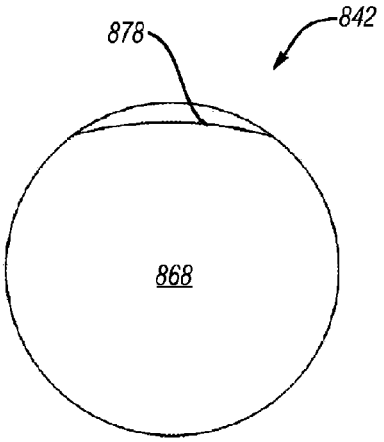
Figures 2, 8:
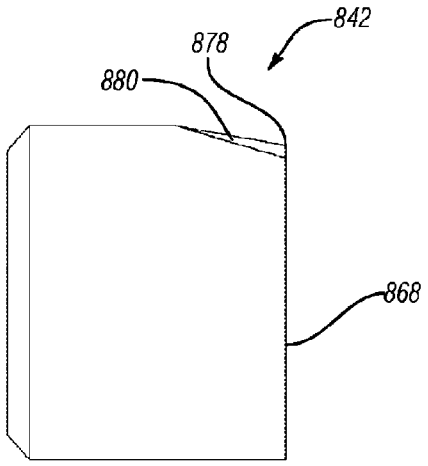
Figures 3, 8:
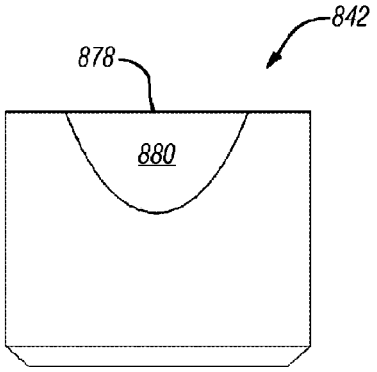
Figures 4, 8:
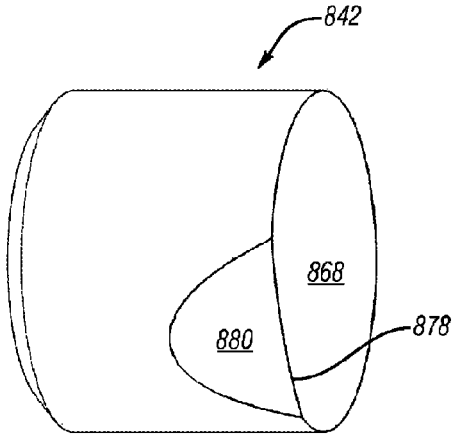

The slanted face 780 is shown in this embodiment as being generally planar; however, those having ordinary skill in the art will appreciate, having the benefit of the present disclosure, that the configuration of the slanted face 780 may vary. For instance, the slanted face 780 may be non-planar. In FIGS. 8-1 to 8-4, for instance, a cutting element 842 is shown as having a curved cutting edge 878 and slanted face 880. As with the other embodiments discussed, herein, the slanted face 880 may be oriented to be non-perpendicular to a cutting face 868 of the cutting element 842. As a result, an acute or obtuse angle may be formed between the cutting face 868 and the slanted face 880. As seen in FIG. 8-2, the amount of the angle may vary. For instance, the angle between an edge of the slanted face 880 (i.e., an end of the cutting edge 878) and the cutting face 868 may be greater than an angle between a center of the slanted face 880 (e.g., a peak of the cutting edge 878) and the cutting face 868. In other embodiments, however, the relationship may be reversed, such as where the slanted face 880 is concave as opposed to convex.

Figure 9:
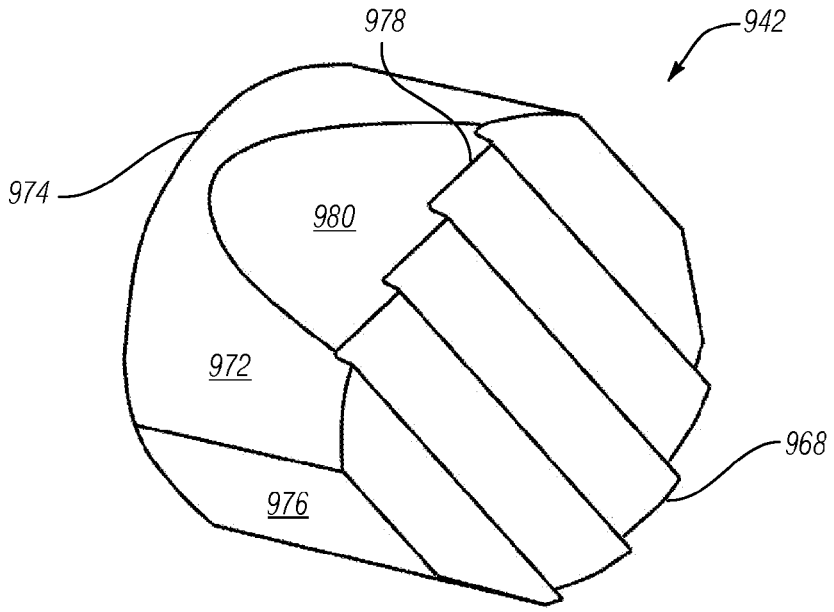
FIG. 9 is a perspective view of a cutting element having an obtuse cutting edge and a ridged cutting face, in accordance with one or more embodiments of the present disclosure.

Additional and other embodiments are contemplated which vary from those previously discussed herein. FIG. 9, for instance, illustrates an example cutting element 942 which may be used as a leading or trailing cutting element of a bit. In this particular embodiment, the cutting element 942 may include a generally cylindrical outer surface 972 extending between a cutting face 968 and a mounting face 974. One or more features may be formed in the outer surface 972 and/or in the cutting face 968. For instance, the cutting face 968 is shown in this embodiment as being non-planar. In particular, the cutting face 968 may include multiple ridges or serrations. Optionally, the outer surface 972 may include one or more locating features 976 for use in positioning the cutting element 942 in a bit and/or for orienting a cutting edge 978 of the cutting element 942 in a desired direction.

The cutting edge 978 may be formed at an interface between the cutting face 968 and the outer surface 972. In some embodiments, the outer surface 972 may include a slanted face 980, and the cutting edge 968 may be formed at an intersection of the cutting face 968 and the slanted face 980. In this particular embodiment, the slanted face 980 may extend generally perpendicular to the ridges or serrations of the cutting face 968. As a result, the cutting edge 978 may include ridges, peaks, serrations, or the like.

Figure 10:
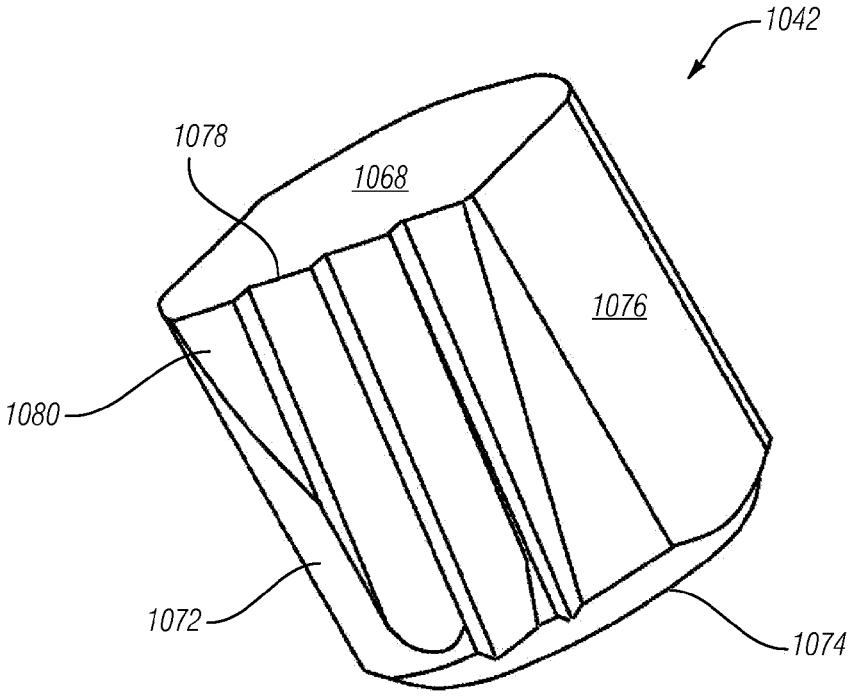
FIG. 10 is a perspective view of a cutting element having an obtuse cutting edge and a ridged outer surface, in accordance with one or more embodiments of the present disclosure.

Rather than having ridges, serrations, or another non-planar feature on the cutting face, or in addition thereto, a cutting element may include such features on the outer surface of the cutting element. FIG. 10, for instance, illustrates a cutting element 1042 including a cutting face 1068 and a mounting face 1074, with an outer surface 1072 extending therebetween. The outer surface 1072 may be generally cylindrical, a rounded square, or have other shapes or configurations.

In this particular embodiment, the cutting face 1068 may be generally planar; however, the outer surface 1072 may include various features formed therein. For instance, a slanted face 1080 may be formed in the outer surface 1072, and angled to be non-perpendicular to the cutting face 1068. In this particular embodiment, the slanted face 1080 may include multiple ridges, protrusions, serrations, or the like. Such features are shown as extending at least partially between the cutting face 1068 and the mounting face 1074. Optionally, one or more locating features 1076 may be formed in the outer surface 1072 to facilitate orientation or locating of the cutting element 1042 on a bit or other device.

A cutting edge 1078 may be formed at the interface between the outer surface 1072 and the cutting face 1068. In a more particular embodiment, an interface between the cutting face 1068 and the slanted face 1080 may define the cutting edge 1078. The cutting edge 1078 has, in this embodiment, an undulating shape as a result of the multiple ridges of the slanted face 1080. In some embodiments, a whole or partial portion of the cutting edge 1078 may be configured, once coupled to a bit or other tool, to engage a workpiece. For instance, the portion of the cutting edge 1078 adjacent the slanted face 1080 may be configured to engage the workpiece while portions of the cutting edge 1078 that are not at the interface with the slanted face 1080 may not be configured to engage and shear, mill, grind, drill, or otherwise cut the workpiece.

Figure 11:
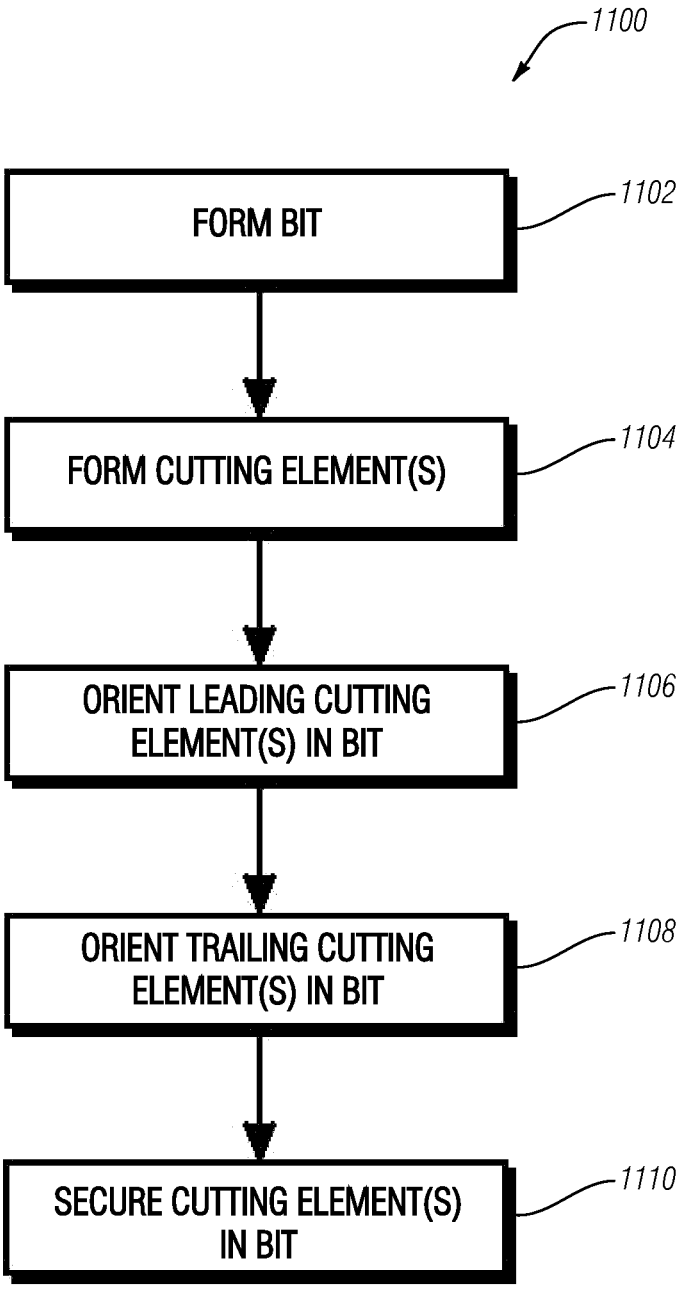
FIG. 11 is a flow chart of a method for forming a bit, in accordance with one or more embodiments of the present disclosure.

In accordance with embodiments of the present disclosure, some aspects of the present disclosure relate to a method for manufacturing a bit. The bit may be a mill bit, a drill bit, a mill-drill bit, or any other bit as would be appreciated by one skilled in the art having the benefit of the present disclosure. An example method 1100 is illustrated in FIG. 11.

The method 1100 for manufacturing a bit may include forming a bit at 1102. Forming the bit may be include any number of processes, including those discussed herein. For instance, carbide particles may be sintered with a binder to form a bit body, steel or another material may be machined to form a bit body, threads may be formed on a pin or box connection, or the like. In at least some embodiments, the bit formed at 1102 may include pockets configured to receive a cutting element. The pockets may have any suitable features including, in some embodiments, features configured to mate or otherwise cooperate with locating features of a cutting element to be inserted into the pocket. Pockets may be formed on first and/or second supporting surfaces of a blade or other feature of a bit body. A first supporting surface may, for instance, support leading cutting elements. Pockets formed on a second supporting surface may, for instance, support trailing cutting elements. In some embodiments, pockets configured to support trailing cutting elements may be formed on an outer radial surface of a blade or other component of a bit body. Pockets or other features formed for use with cutting elements may be formed at a desired side and/or back rake angle.

Prior to, after, or concurrent with forming the bit at 1102, one or more cutting elements may be formed at 1104. The cutting elements that are formed at 1104 may include leading cutting elements, trailing cutting elements, gauge protection elements, or the like. Such cutting elements may have any number of forms, configurations, and the like.

For instance, cutting elements formed at 1104 may include cutting elements with a circular, planar cutting face and a cylindrical outer surface. In other embodiments, cutting elements with semi-round top, conical, frusto-conical, or other two or three-dimensional cutting face may be formed. The outer surface may also be conical, square, a rounded square, have other features therein, or include a combination of the foregoing. For instance, in some embodiments cutting elements formed at 1104 may include trailing cutting elements configured for use in a milling operation.

One or more of the cutting elements formed at 1104 may include an obtuse cutting edge at an interface between a cutting face and a slanted face of the outer edge. Where the cutting face is planar, the cutting face may be perpendicular to at least a portion of the outer surface. The slanted face, however, may not be perpendicular to the cutting face. Where an angle between the slanted face and the cutting face is obtuse, the cutting edge may be an obtuse cutting edge. In other embodiments, the cutting edge may be an acute or a right cutting edge. In at least some embodiments, the cutting face may not be planar. In such embodiments, the angle between the cutting face and the slanted face may be measured between the sloped surface and a cross-section of the cutting element as taken through the cutting edge.

The cutting elements formed at 1104 may be formed in any suitable manner. As discussed herein, some cutting elements may be formed of a metal carbide and/or as a PDC. In such embodiments, one or more surface features (e.g., slanted faces, locating features, non-planar cutting faces, etc.) may be formed in the cutting element by a suitable manufacturing process. On example process may include using a can or form such that the surface features are formed upon initial formation of the cutting element. Another example process may include post-processing, such as by grinding, abrading, or otherwise removing material from the cutting element after the cutting element has been pressed, sintered, or otherwise formed. For instance, in the case of cutting element with an obtuse cutting edge formed by a slanted face, a pressing, sintering, or other forming process may shape the cutting element to include the slanted face and cutting edge. In another embodiment, a cylindrical cutting element may be formed and a grinding or other process may be used to form the slanted face.

Following forming of the bit at 1102 and forming the cutting elements at 1104, one or more leading cutting elements may be oriented in the bit at 1106 and/or one or more trailing cutting elements may be oriented in the bit at 1108. Orienting the cutting elements in the bit at 1106, 1108 may include orienting a cutting edge. For instance, a cutting element may include a cutting edge that does not extend around a full perimeter of the cutting element. Such cutting edge may be oriented in a direction (optionally with desired back and/or side rake) to perform a desired function. As an example, a leading or a trailing cutting element in a mill-drill bit may be configured for use in a milling operation, and the cutting edge may be oriented outward (see FIG. 4). In some embodiments, a trailing cutting element may be used in a milling or other operation prior to drilling performed primarily by leading cutting elements configured for a drilling operation. The cutting edge of the trailing cutting element may be oriented in a pocket or other location of the mill-drill bit so as to be configured to engage casing, downhole tooling, or other components as desired for the milling operation. In some embodiments, a leading or a trailing cutting element oriented in a bit may have an obtuse cutting edge.

In the case of cutting elements with surface features such as a slanted face and/or obtuse (or otherwise angled) cutting edge, the cutting elements may be oriented in the bit at 1106, 1108 following forming of the features in the cutting elements. Thus, orienting the cutting elements at 1106 and/or at 1108 may include orienting surface features produced prior to inserting the cutting element into the bit. This may be in contrast, for instance, to use of a bit in which a wear flat or other feature may be formed in a cutting element during use of the bit. In such a process, the wear flat may not exist prior to use of the bit, and such feature may therefore not be present during orienting of the cutting elements in the bit at 1106 and/or 1108. In some cases, a wear flat may also be formed during a milling or drilling operation, but the wear flat may not produce an obtuse cutting edge as discussed with respect to some embodiments of the present disclosure. In some embodiments, a surface feature pre-formed in the cutting element may resemble a pre-formed wear flat.

After the cutting elements are oriented at 1106, 1108, the cutting elements may be secured in the bit at 1110. Securing the cutting elements to the bit at 1110 may include, for instance, press-fitting, brazing, welding, or otherwise coupling the cutting elements to the bit.

The elements of the method 1100 of FIG. 11 are merely illustrative, and one skilled in the art will appreciate that some elements may be omitted and/or other elements may be added. Additionally, not each of the elements may be performed by the same party or entity. For instance one party may form the bit at 1102, one or more other parties may form the cutting elements at 1104, and still another party may orient the cutting elements at 1106, 1108 and secure the cutting elements to the bit at 1110. In some embodiments, a method performed by a single party may therefore remove or modify elements of the method 1100. For instance, a party may order and/or obtain a pre-manufactured bit body in lieu of directly forming the bit at 1102. Similarly, the party may order or obtain pre-manufactured cutting elements in lieu of directly forming the cutting elements at 1104.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation for each embodiment within the scope of the description or claims. For example, a component of a bottomhole assembly that is described as "below" another component may be further from the surface while within a vertical wellbore, but may have a different orientation during assembly, when removed from the wellbore, or in a lateral or other deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or machined from the same one or more pieces of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination. Features and aspects of methods described herein may be performed in any order.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

Sidetracking systems, steerable drilling systems, mills, drill bits, BHAs, cutting elements, other components discussed herein, or which would be appreciated in view of the disclosure herein, may be used in other applications and environments. In other embodiments, for instance, milling tools, drilling tools, mill-drill tools, cutting elements, methods of milling, methods of drilling, methods of milling and drilling, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, that a particular value may be selected, or an upper or lower limit may be identified using any identified value. Numbers, percentages, ratios, measurements, or other values stated herein are intended to include the stated value as well as other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value.

The Abstract included with this disclosure is provided to allow the reader to quickly ascertain the general nature of some embodiments of the present disclosure. The Abstract is submitted with the understanding that it will not be used to interpret or limit the scope or meaning of the claims.

What is claimed is:

1. A cutting element, comprising:

a cutting face;

a planar slanted face formed in a rounded outer surface, the rounded outer surface including at least one planar locating feature; and an obtuse cutting edge at an interface between the cutting face and the planar slanted face.

2. The cutting element of claim 1, the cutting face being non-planar.

3. The cutting element of claim 2, the cutting face including multiple ridges.

4. The cutting element of claim 1, planar slanted face having a parabolic outer edge.

5. The cutting element of claim 1, further comprising:

a mounting face opposite the cutting face, the planar slanted face extending from the obtuse cutting edge partially along a height of the cutting element toward the mounting face, the cutting face, the mounting face, and the planar slanted face being formed of a metal carbide.

6. The cutting element of claim 1, the cutting face being formed of one or more superhard or superabrasive materials.

7. The cutting element of claim 1, the planar slanted face being formed of a metal carbide and diamond.

8. The cutting element of claim 1, the planar slanted face being formed pre-formed in a manufacturing process.

9. The cutting element of claim 1, the obtuse cutting edge being at an angle between 90.5° and 99° relative to the cutting face.

10. The cutting element of claim 9, the obtuse cutting edge being at an angle between 92.5° and 97.5 relative to the cutting face.

11. The cutting element of claim 1, the rounded outer surface being generally cylindrical.

12. The cutting element of claim 1, the rounded outer surface being a rounded square.

13. A bit, comprising:

a bit body;

a plurality of blades extending radially from the bit body;

a plurality of leading cutting elements coupled to the plurality of blades, the plurality of leading cutting elements having a first shape; and a plurality of trailing cutting elements coupled to the plurality of blades, the plurality of trailing cutting elements including one or more cutting elements having a second shape different than the first shape, the second shape including an obtuse cutting edge, at an interface between a cutting face of the one or more cutting elements and a planar slanted face of the one or more cutting elements, the planar slanted face formed in a rounded outer surface of the one or more cutting elements, the rounded outer surface including at least one planar locating feature.

14. The bit of claim 13, the second shape including a serrated cutting face.

15. The bit of claim 13, the one or more cutting elements of the plurality of trailing cutting elements including a generally cylindrical outer surface having at least one or more of:

a bevel; or a chamfer.

16. The bit of claim 13, the obtuse cutting edge being formed at least partially by a slanted face that is inclined between 90.5° and 99° relative to a cutting face, and which is:

planar;

curved;

ridged;

rectangular;

or parabolic.

17. The bit of claim 13, the plurality of trailing cutting elements being configured for use in a milling operation and the plurality of leading cutting elements being configured for use in a drilling operation.

18. A method, comprising:

orienting one or more leading cutting elements on a blade of a bit;

orienting one or more trailing cutting elements on the blade of the bit such that an obtuse cutting edge of the one or more trailing cutting elements is configured to contact a workpiece during a cutting operation, the one or more trailing cutting elements having a different shape than the one or more leading cutting elements; and securing the one or more leading cutting elements by matching a planar locating feature on the one or more leading cutting elements with a corresponding pocket locating feature on the bit and the one or more trailing cutting elements to the bit by matching a locating feature on the one or more trailing cutting elements with the corresponding pocket locating feature on the bit.

19. The method of claim 18, further comprising:

in a first operation, milling metal of the workpiece with the one or more trailing cutting elements, wherein milling the metal wears the one or more trailing cutting elements and thereby exposes the one or more leading cutting elements to the workpiece; and after the first operation, and in a second operation, drilling formation around the workpiece with the one or more leading cutting elements.

* * * * *